United States Patent [19]

McArdle et al.

[11] 4,166,474

[45] Sep. 4, 1979

[54] COSMETIC CONTAINER CONSTRUCTION

[75] Inventors: James M. McArdle; Eric J. Idec, both of Cheshire; Francis G. Marshall, Meriden, all of Conn.

[73] Assignee: Eyelet Specialty Co., Inc., Wallingford, Conn.

[21] Appl. No.: 775,522

[22] Filed: Mar. 8, 1977

[51] Int. Cl.[2] ..... A45D 40/26

[52] U.S. Cl. ..... 132/88.7

[58] Field of Search ..... 132/88.7, 88.5, 73, 132/79, 79.2, 75; 401/65–68, 62, 55, 86, 75–78, 125, 127, 61; 206/56

[56] References Cited

U.S. PATENT DOCUMENTS

| | | | |
|---|---|---|---|
| 2,592,183 | 4/1952 | Peterson et al. | 401/61 |
| 3,789,857 | 2/1974 | Ikeda | 132/88.7 |
| 3,907,441 | 9/1975 | Idec | 401/75 |

FOREIGN PATENT DOCUMENTS

| | | | |
|---|---|---|---|
| 271731 | 9/1968 | Austria | 132/88.7 |

*Primary Examiner*—G. E. McNeill

*Attorney, Agent, or Firm*—Hopgood, Calimafde, Kalil, Blaustein & Lieberman

[57] ABSTRACT

A propel-repel swivel cosmetic container features basic lead-screw and nut parts, each of which is a single injection-molded piece of plastic material with certain further integral formations such that a variety of aesthetically satisfying overall appearances is available upon assembly to particular tubular further parts, thereby providing a variety of different-appearing cosmetic containers utilizing in common the same basic lead-screw and nut propulsion mechanism.

12 Claims, 4 Drawing Figures

24
15
16
13
11
10
23
25
20
22
19
29
28
32
b
a
A
12
31
35
36
39
37
38
14
40
ΔR
B
17
27
26
21
30
45
46
35'

COSMETIC CONTAINER CONSTRUCTION

This invention relates to cosmetic containers of the propel-repel swivel type, wherein longituinal displacement results from coaction between relatively rotatable elements.

The cosmetic-container manufacturer must satisfy a relatively large number of cosmetic manufacturers, each of which is anxious to place his wares before the public in a distinctive dress, i.e., with the appearance of being unique to the cosmetic manufacturer. But with competitive pressures, it becomes almost prohibitively costly to provide a new and totally different container for each customer. It thus suffices that the container be at least unique in appearance for each cosmetic manufacturer, and so basic mechanisms may be made to serve the requirements of a number of cosmetic-manufacturing customers, with additional custom parts being of unique external appearance and held to a minumum of custom work. The basic propulsion mechanism used for such purposes has in the past comprised three parts which today are conveniently and conventionally each of injection-molded plastic construction, namely, inner and outer relatively rotatable tubular members, and a carrier cup, the cup having radially outward cam-follower means to engage cam formations in the tubular members.

It is an object of the invention to provide improved basic propulsion means of the character indicated, lending itself to employment of a wide range of external decorative applications.

A specific object is to achieve the above object with basic propulsion mechanism employing but two, rather than the conventional three, parts.

A further specific object is to achieve the above objects with basic propulsion parts of injection-molded plastic.

Another specific object is to provide basic propulsion elements meeting the above objects and using an outer metal tubular member forming part of the external decor as well as a functional contribution to container operation.

A general object is to meet the foregoing objects with structure of elemental simplicity, inherent reliability, low cost, and ready adaptability to automated or semi-automated container assembly and cosmetic filling.

Other objects and various further features of the invention will be pointed out or will occur to those skilled in the art from a reading of the following specification in conjunction with the accompanying drawings. In said drawings, which show, for illustrative purposes only, a preferred form of the invention:

Figures 1, 2, 3, 4:
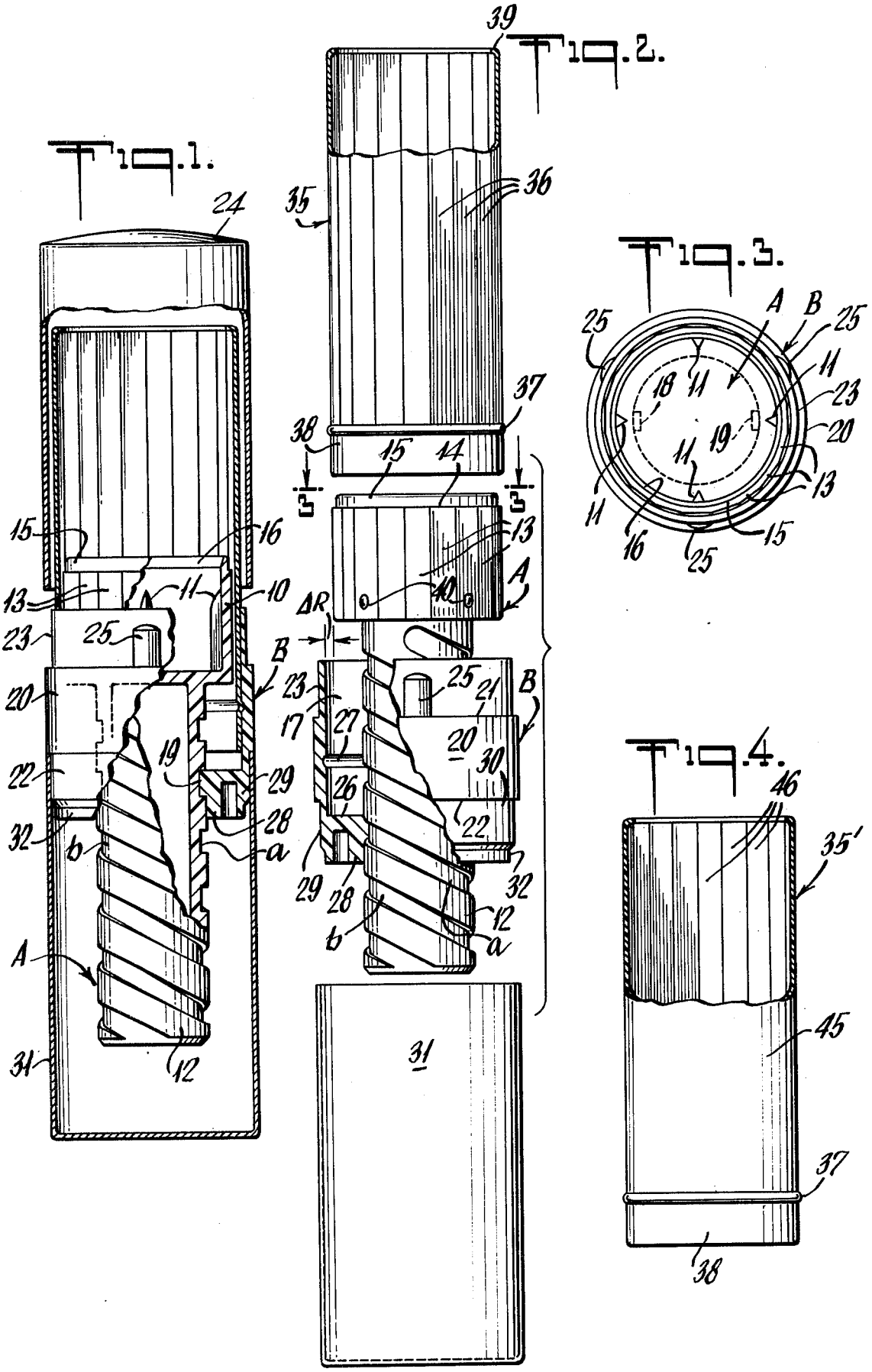
FIG. 1 is a view of a container of the invention in side elevation, with parts broken away and in longitudinal section.
FIG. 2 is an exploded view of parts of FIG. 1, otherwise meeting the general description of FIG. 1.
FIG. 3 is a plan view of basic propulsion elements of FIGS. 1 and 2, the view being taken as at 3—3 in FIG. 2.
FIG. 4 is a view in vertical elevation, partly broken and in section, to show modification of a part of the container of FIG. 1.

In the drawings, the invention is shown in application to a cosmetic container having essentially a two-part propulsion mechanism, upon which or to which relatively simple outwardly exposed finishing parts are assembled to complete the container, in accordance with the custom external-appearance requirements of a particular customer. The two propulsion-mechanism parts are generally designated A and B, respectively, and in FIG. 2 are shown loosely assembled to each other.

The part A comprises an upwardly open carrier cup 10 with internal ribs 11 to engage and permanently support a lipstick or the like (not shown) in cantilevered projection beyond the open end of cup 10. Integrally formed with the closed lower end of cup 10 is an elongate reduced tail 12 which may be hollow (to an open lower end) and which is characterized by external lead-screw thread formations involving like helical thread grooves a-b in interlaced double-lead relation. The side wall or skirt of cup 10 is externally characterized by polygonal faces 13 extending to upper shoulder 14, beyond which a short sleeve-like projection 15 defines an upper lip, for stabilizing and filling purposes which will later become more clear; a slight flare 16 in the bore of cup 10 at lip 15 also aids in filling with cosmetic material. The carrier or lead-screw part A is a single injection-molded piece, formed of a suitable plastic material such an an acetyl resin.

The nut part B comprises an upwardly open cup defining an interior cavity 17 of sufficient bore diameter to provide a radial clearance $\Delta R$ to receive a finishing-part assembly to be described, and nut formations 18–19 at a central opening in an otherwise closed lower end are engaged to the respective threads a-b of the tail 12. These nut formations are shown as like, diametrically opposed short inward projections of rounded configuration. Externally, the cup part B is characterized by a central band 20 between upper and lower shoulders 21–22. A reduced band 23 is thus defined for removable telescoped reception of a "free-wheeling" closure cap 24, aided by friction-retention ribs 25 at plural spaced locations on band 23 and adjacent shoulder 21. Together, the bands 20–23 are seen to define a sleeve portion projecting upward from the "closed" end of part B; the volume within cavity 17 is also seen as ample for full containment of cup 10 when parts A and B are in fully retracted position, cup 10 being then squarely seated on the bottom wall 26 of cavity 17, and the clearance $\Delta R$ extending to said bottom wall. The bore of cavity 17 is cylindrical, except for a central groove or undercut 27, for assembly-retention purposes to be explained.

To complete the description of nut part B, short radially spaced inner and outer sleeve portions 28–29 project downwardly from the "closed" end wall 26. The inner sleeve portion 28 provides an axially extensive base for definition of nut or cam-follower formations 18–19 as like radially inward cylindrical projections from an otherwise smoothly cylindrical bore, for smooth circumferential bearing support of the wide cylindrical lands of tail 12, between successive turns of the thread grooves a-b. The outer sleeve portion 29 enables definition of a reduced lower band 30 beneath shoulder 22 and axially straddling the "closed" end wall 26, so as to provide maximum radially compressive reinforcement for force-fitted assembly of a finishing part 31; as shown, a short reduced end 32 of outer sleeve portion 29 has bevel connection to band 30, to aid non-fouling assembly of the force-fit.

As with part A, the nut part B is a single injection-molded piece, formed of a suitable plastic material, such as polypropylene. And since the central band 20 is externally exposed, color and optional fillers provide a simple and inexpensive range of choice from which the cosmetic manufacturer may specify one element of an overall external appearance which may be part of his "customized" container.

As indicated above, parts A and B are the basic propulsion elements of the entire container. Except for color (and possible filler) in the plastic material of part B, the remaining finishing parts determine overall appearance. In the form shown in FIGS. 1 to 3, these finishing parts are of metal and essentially tubular. Of these finishing parts, the force-fitted base cover 31 has already been identified; it may be injection-molded of suitable plastic but is shown as a thin cylindrical cup, as of drawn aluminum, thus lending itself to a variety of external finish options, e.g., "brushed", anodized, with or without relief-contouring. The one remaining finish part of the container per se is an elongate outer tubular shell 35 which is also shown as thin-walled and metallic, as of drawn aluminum; shell 35 is characterized by elongate polygonal walls or faces 36 which extend the major fraction of the length of shell 35 and have non-rotational sliding engagement with the polygonal faces 13 of part A. At the lower end of shell 35, a circumferential bead 37 separates the polygonal faces 36 from a cylindrical bearing portion 38, for smooth rotational support in the lower end of cavity 17, once bead 37 is assembled by snap action into the retaining groove 27. At its upper end, shell 35 includes a short in-turned lip flange 39, sized for clearance with the reduced land 15 of part A, but for upper-portion limiting interference with shoulder 14 of part A. For smooth-acting, light frictional action, and to eliminate radial play of the parts, a few spaced small friction bumps or ribs 40 in some of the faces 13 of part A, will suffice to take up size variations within manufacturing tolerances for the exterior of cup 10 and the interior of walls 36, assuring lightly stressed uniform preload of the sliding engagement; for example, for a 20-faced polygonal formation at 36, the bumps 40 may be at every fourth or fifth face 36.

The last part of the container has already been identified as the closure cap 24. This is shown as of thin-walled metal, such as drawn aluminum and having removable free-wheeling engagement to land 23 over friction ribs 25. The range of finishes is as varied as for the force-fitted bottom cap 31, which for aesthetic purposes may be of the same longitudinal extent as cap 24 but which in any event must provide sufficient interior capacity to fully accommodate tail 12 for the fully retracted condition of part A.

The described construction will be seen to have achieved all stated objects. The construction lends itself to automated assembly, in that every part is readily sensed for end identification and therefore for unambiguous orientation. The basic propulsion parts A-B are first assembled to each other, as shown in FIG. 2. The bottom closure 31 may then be force-fitted, and the shell 35 snap-fitted, ino their axially-retained assembled relation to part B, with keyed engagement of the polygonal formations 13-36. The container is now ready for operation, between its bottom or retracted position of cup 10 seated at wall 26, to its top-limited position of lip-flange (39) interference with shoulder 14, there being smooth acting light frictional engagement of the sliding parts at all times. To fill the container, part A is advanced, by rotation of cap 31 with respect to shell 35, to the described upper limiting position of cup 10, at which point the reduced land 15 projects through and beyond the lip flange 39. Automatic filler (pomade) insertion mechanism (not shown) may then concentrically locate upon the externally projecting end of land 15, thereby avoiding any misalignment of the pomade with respect to the bore of cup 10.

While the invention has been described in detail for the preferred form of FIGS. 1 to 3, it will be understood that modifications may be made without departure from the scope of the invention. For example, desirable customized appearance variations are extended by employment of molded plastic parts at 31 and/or 35, and in the event of molded plastic for shell 35, the outer finish need not be polygonal, although the described polygonal bore must be compatible with the polygonal cup formations at 13. For example, an aesthetically pleasing "custom" appearance is achieved where shell 35 is of molded plastic, with a cylindrical outer surface 45 and a polygonal inner surface 46, as shown for shell 35' in FIG. 4, especially when the plastic material is translucent or pearlescent, or with the inner surface 36 metalized such that the polygonal faces provide mirror-reflection for external light incident upon an passing through the shell.

What is claimed is:

1. In a propel-repel cosmetic container wherein (a) an elongate tubular outer shell is characterized by polygonal wall formations along a major portion of its length and includes a rotary bearing portion at a longitudinal end thereof, (b) a carrier member is slidably positionable along said major extent and has corresponding polygonal faces in non-rotatable engagement with the inner surfaces of said wall formations, said carrier member being of single-piece injection-molded plastic construction and openly cupped at one end to receive and support cosmetic material in cantilevered projection beyond said one end, said carrier member integrally including at its other end an elongate tail having external thread formations, and (c) a cupped base-end closure in rotational and axially located engagement with said bearing portion and accommodating said tail when said carrier member is in its fully retracted position, said closure including a nut formation in threaded engagement with said thread formations, the improvement wherein said nut formation is part of a cupped nut member apart from but in permanently secured assembly to a cupped base member to complete said base-end closure, said nut member having a cup-member-engaged portion and the bore of the cup of said nut member having a bearing-portion-engaged portion and being of single-piece injection-molded plastic construction, whereby said carrier and nut members may constitute a two-piece basic subassembly of coacting propulsion parts having inherent universal application in combination with a variety of styles, shapes, materials and formations of said tubular outer shell and of said cupped base member to provide at relative economy a range of different products all of which utilize said carrier and nut members.

2. The container improvement of claim 1, in which said tubular outer shell is of thin-walled metal and having said polygonal formations externally exposed.

3. The container improvement of claim 1, in which said tubular outer shell is of injection-molded plastic material.

4. The container improvement of claim 3, in which said outer shell molded plastic material is translucent.

5. The container improvement of claim 1, in which the bearing-portion-engaged portion of said nut member comprises a longitudinally projecting sleeve portion having rotatable telescoped engagement over the bearing-portion end of said shell, said polygonal wall formations extending longitudinally beyond said sleeve portion, and longitudinally retaining snap-engageable coacting means including a circumferentially continuous bead formation on one of said bearing and sleeve portions.

6. The container improvement of claim 5, in which said snap-engageable means comprises a radially outward circumferential bead at said bearing portion in engagement with a circumferential groove in the bore of said sleeve portion.

7. The container improvement of claim 5, in which said sleeve portion is of lesser peripheral extent than the maximum peripheral extent of said nut member and is of greater peripheral extent than the peripheral extent of the polygonal portion of said sleeve, thereby defining a shoulder at the base end of said sleeve portion, a local friction-engageable projection near the base end of said sleeve portion, and closure-cap means having removable friction engagement over said shell and to said sleeve portion at said shoulder.

8. The container improvement of claim 5, in which said nut member includes concentric inner and outer radially spaced short sleeve portions integrally formed with said other end of said nut member, the inner one of said short sleeve portions having nut-thread formations of said tail.

9. The container improvement of claim 8 and including a cupped closure member is in permanently secured assembly to said outer short sleeve portion.

10. The container improvement of claim 8, in which said nut-thread formations comprise two like local radially inward projections, and in which the thread formations of said tail comprise two like helices in interlaced double-lead relation.

11. The container improvement of claim 9, in which a radially outward circumferentially continuous shoulder divides said first-mentioned sleeve portion from said outer short-sleeve portion, said cupped closure member being assembled in longitudinal adjacency with said shoulder.

12. As an article of manufacture, a two-piece basic subassembly of coacting propulsion parts having inherent universal application as the propulsion mechanism of a cosmetic container when combined with selected tubular members of a variety of styles, shapes, materials and formations, said subassembly comprising a nut member and a carrier member having an elongate tail in threaded engagement with said nut member, said nut member being a generally cylindrical cup having a closed end with a threaded bore and having a skirt with a cylindrical bore, said skirt having an outer surface that is characterized by axially outwardly accessible reduced lands at its axial ends, said lands terminating at shoulder formations at the axially central locations of said cup, said carrier member having a pomade-cup formation at its end remote from the closed end of said nut, said pomade-cup formation having external polygonal wall formations in radial clearance with the bore of the nut-member skirt, and the bore of said skirt having a detent-engageable formation for axial retention of an inserted tubular outer shell having a polygonal bore to key with said polygonal pomade-cup formations, whereby said subassembly may universally serve a selected one of a plurality of tubular outer shells detent-assembled to said nut-member skirt, while also serving a selected one of a plurality of cupped tubular base members assembled to the lower land of said nut member, and a selected one of a plurality of cupped tubular closure members assembled to the upper land of said nut member.

* * * * *